US005894704A

United States Patent [19]

Watkins

[11] Patent Number: 5,894,704

[45] Date of Patent: Apr. 20, 1999

[54] WALL CONSTRUCTION PROCESS

[76] Inventor: Michael W. Watkins, 9588 SVL Box, Victorville, Calif. 92392

[21] Appl. No.: 08/805,595

[22] Filed: Feb. 25, 1997

[51] Int. Cl.[6] ..... E04B 1/16; E04G 23/00

[52] U.S. Cl. ..... 52/745.09; 52/745.05; 52/295; 52/351; 52/358; 52/348

[58] Field of Search ..... 52/741.13, 741.41, 52/745.05, 745.09, 309.12, 344, 295, 351, 358, 363, 348

[56] References Cited

U.S. PATENT DOCUMENTS

| | | | |
|---|---|---|---|
| 1,623,338 | 4/1927 | Goldsmith | 52/351 |
| 3,315,424 | 4/1967 | Smith | 52/745.05 X |
| 3,402,522 | 9/1968 | Guddal | 52/745.09 |
| 3,959,940 | 6/1976 | Ramberg | 52/745.09 X |
| 4,472,919 | 9/1984 | Nourse | 52/344 X |
| 4,578,915 | 4/1986 | Schneller | 52/309.12 |
| 4,918,897 | 4/1990 | Luedtke | 52/745.05 X |
| 4,987,719 | 1/1991 | Goodson, Jr. | 52/745.09 X |

*Primary Examiner*—Christopher Kent
*Assistant Examiner*—Yvonne Horton-Richardson
*Attorney, Agent, or Firm*—Joseph N. Breaux

[57] ABSTRACT

A wall construction process including the steps of: providing a retaining mold for retaining a concrete slurry; installing reinforcing rods; at least partially filling the retaining mold with a concrete slurry mixture; allowing sufficient time for the concrete slurry mixture to solidify into a footing; constructing a reinforcing screen vertically oriented with respect to the footing; providing a plurality of spacers; placing the plurality of spacers to the reinforcing screen; providing a plurality of sheets of a foam insulating material having a first and second substantially planar surface; positioning one of the first and second surfaces against the spacers; providing a plurality of sheets of sheet-form lathe; positioning the plurality of sheets of sheet-form lathe against the remaining first and second surfaces of the foam insulation that are not against the spacers, providing a plurality of fasteners; fastening the plurality of sheets of sheet-form lathe, the plurality of sheets of foam insulation material, and the spacers to the reinforcing screen; and blowing a blown concrete mixture against the plurality of sheets of foam insulation material from a direction wherein the reinforcing screen is positioned between the plurality of sheets of foam insulation material and the nozzle from which the blown concrete is discharged.

1 Claim, 2 Drawing Sheets

WALL CONSTRUCTION PROCESS

TECHNICAL FIELD

The present invention relates to processes for constructing walls from concrete and more particularly to a process of constructing the load bearing walls of a concrete building without building a removable concrete form.

BACKGROUND ART

Buildings constructed from concrete offer superior durability, safety and energy efficiency than other types of construction. Although concrete buildings have many benefits, they are more expensive to construct than building constructed from conventional brick and wood construction. This added expense is mainly attributable to the concrete forms that must be constructed prior to pouring or blowing the concrete that forms the walls of the building. Additionally, these forms must be removed after the concrete has cured calling for additional time and labor. It would be a benefit, therefore, to have a process for constructing the sections of concrete wall forming a building that did not require the construction and removal of forms for containing the concrete during the curing period.

Additionally, although concrete construction is energy efficient, concrete can be relatively porous and exterior concrete surfaces can absorb and transmit water into the interior of the building causing a musty smell and mildew. It would be a benefit, therefore, to have a process for constructing the exterior walls of a building from concrete along with a conventional outer wall surface such as stucco. It would of course also be desirable if such processes utilized readily available materials.

GENERAL SUMMARY DISCUSSION OF INVENTION

It is thus an object of the invention to provide a process of constructing the bearing walls of a concrete building that is less expensive to implement than conventional concrete wall building processes.

It is a further object of the invention to provide a process to constructing a building having load bearing walls constructed using a novel combination of readily available materials.

It is a still further object of the invention to provide a blown concrete wall construction process that does not require the use of removable forms for retaining the concrete during the curing period.

It is a still further object of the invention to provide a wall construction process that accomplishes all or some of the above objects in combination.

Accordingly, a wall construction process is provided. The construction process comprises the steps of: providing a retaining mold, such as a trench or other conventional mold for forming a concrete footing, for retaining a concrete slurry; installing reinforcing rods within the retaining mold in a manner such that vertical dowels extend upwardly past the retaining mold; at least partially filling the retaining mold with a concrete slurry mixture in a manner such that the vertical dowels remain above the surface of the concrete mixture; allowing sufficient time for the concrete slurry mixture to solidify into a footing; constructing a reinforcing screen vertically oriented with respect to the footing and in connection with the vertical dowels; providing a plurality of spacers; placing the plurality of spacers to the reinforcing screen in a manner such that the spacers define a plane against which a substantially planar surface may be positioned; providing a plurality of sheets of a foam insulating material having a first and second substantially planar surface; positioning one of the first and second surfaces against the spacers; providing a plurality of sheets of sheet-form lathe; positioning the plurality of sheets of sheet-form lathe against the remaining first and second surfaces of the foam insulation that are not against the spacers, providing a plurality of fasteners; fastening the plurality of sheets of sheet-form lathe, the plurality of sheets of foam insulation material, and the spacers to the reinforcing screen in a manner such that each sheet of the plurality of sheets of foam insulation material is in contact with at least one spacer and the at least one spacer is positioned between one of sheets of foam insulation material and the reinforcing screen; and blowing a blown concrete mixture against the plurality of sheets of foam insulation material from a direction wherein the reinforcing screen is positioned between the plurality of sheets of foam insulation material and the nozzle from which the blown concrete is discharged. The blown concrete is blown until the reinforcing screen is embedded within blown concrete and the wall shaped and allowed to cure as in conventional blown concrete construction.

An outer surface of stucco can then be applied to the outwardly facing side of the sheet-form stucco lathe. In addition, areas can be cut out of the foam insulation and sheet-form lathe, and prehung door and window units positioned within the cutout areas prior to blowing the blown concrete. Of course, when prehung door and/or window units are to be provided in the wall to be constructed, the reinforcing screen is constructed to provide open areas for the door and window units. It can be appreciated that because the blown concrete is blown against the sheets of foam insulation material, the requirement for constructing removable forms is eliminated. The elimination of the need to use removable forms provides a savings in the cost of the form materials, transportation costs incurred for moving the form materials to the building site, and the labor required to erect and dismantle the forms. Also, as with conventional blown concrete construction, plumbing and electricals are provided within the area to receive the blown concrete prior to blowing the concrete.

BRIEF DESCRIPTION OF DRAWINGS

For a further understanding of the nature and objects of the present invention, reference should be had to be following detailed description, taken in conjunction with the accompanying drawings, in which like elements are given the same or analogous reference numbers and wherein.

EXEMPLARY MODE FOR CARRYING OUT THE INVENTION

The process will be described with respect to the construction of a single representative wall section. It is appreciated by those skilled in the construction arts that the building is constructed from a number of such wall sections.

Figure 1:
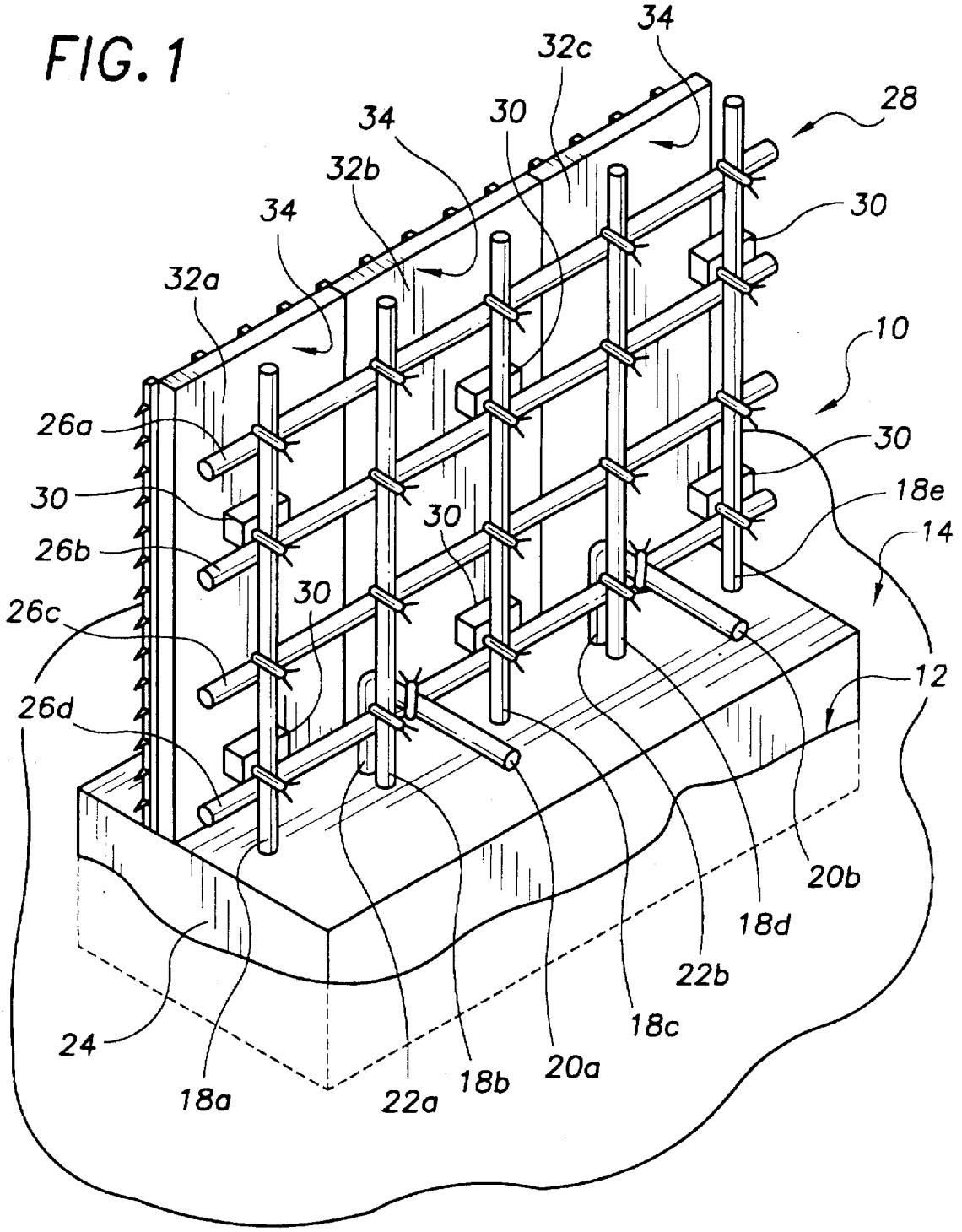
FIG. 1 is a perspective view showing a partially constructed wall section constructed in accordance with the process of the present invention including a representative footing, a reinforcing screen, a number of spacers secured to the reinforcing screen, three sheets of foam insulation, the stucco lathe, and a number of horizontal floor reinforcing bars extending at right angles to the interior side of the wall to be constructed.

FIG. 1 shows a representative partially constructed section of wall generally designated by the number 10. To get to this stage of construction a trench 12 was dug into the soil 14. A number of reinforcing bars 16 (see FIG. 2) were laid along the length of trench 12 and, in this embodiment, five vertical dowel members 18*a–e* were wired to reinforcing bars 16 and positioned in a vertical position and along a center line of the footing to be constructed. Vertical dowel members 18*a–e* extend above the top of wall section 10 to allow for continuity of the reinforcing between wall section 10 and a second story wall or a roof structure.

Two horizontal floor reinforcing bars 20*a*,20*b* were also wired to reinforcing bars at a first horizontal end. A midportion 22*a*,22*b*, of each reinforcing bar 20*a*,20*b*, respectively, was bent to extend vertically from each first horizontal end and then a second end was bent at about a ninety degree angle and oriented substantially perpendicular to vertical dowels 18*a–e*.

Once reinforcing bars 16, vertical dowel members 18*a–e*, and horizontal reinforcing bars 20*a*,20*b* were in place, a slurry of concrete was poured into trench 12, leveled and allowed to cure to form a footing 24. After the concrete forming footing 24 had hardened sufficiently to allow work to continue on wall 10, four horizontal screen reinforcing bars 26*a–d* were wired across vertical dowels 18*a–e* to form a reinforcing screen 28 that will be completely encased within the concrete wall after completion. In this embodiment, reinforcing screen 28 has substantially rectangular openings, however, different patterns can be used to form reinforcing screen without departing from the scope and spirit of the process herein taught and described.

After reinforcing screen 28 was completed, six plastic spacers 30 were provided and secured to reinforcing screen 28 in two rows. Although two rows of spacers 30 are used in the exemplary method, the number and positions of spacers 30 need only be selected to provide a sufficient number of spacers 30, at a sufficient number of locations, to keep the sections of foam insulation 32*a–c* oriented in a substantially vertical orientation with respect to footing 24 and spaced a distance from reinforcing screen 28 sufficient to allow reinforcing screen 28 to be encased within concrete during the concrete blowing step.

After spacers 30 were in place, the first surfaces 34 of each of three section 32*a–c* of foam insulation were positioned against spacers 30 and sections of sheet-form stucco lathe 36 placed against the second opposite surfaces 38. The stucco lathe 36, foam insulation 32*a–c* and spacers 30 were then secured to reinforcing screen 28 with lengths of wire wrapping 31 by inserting two ends of wire wrapping 31 through stucco lathe 36, foam insulation 32*a–c* and spacers 30, and then twisting the ends of wire wrapping 31 about a section of reinforcing screen 28.

Figure 2:
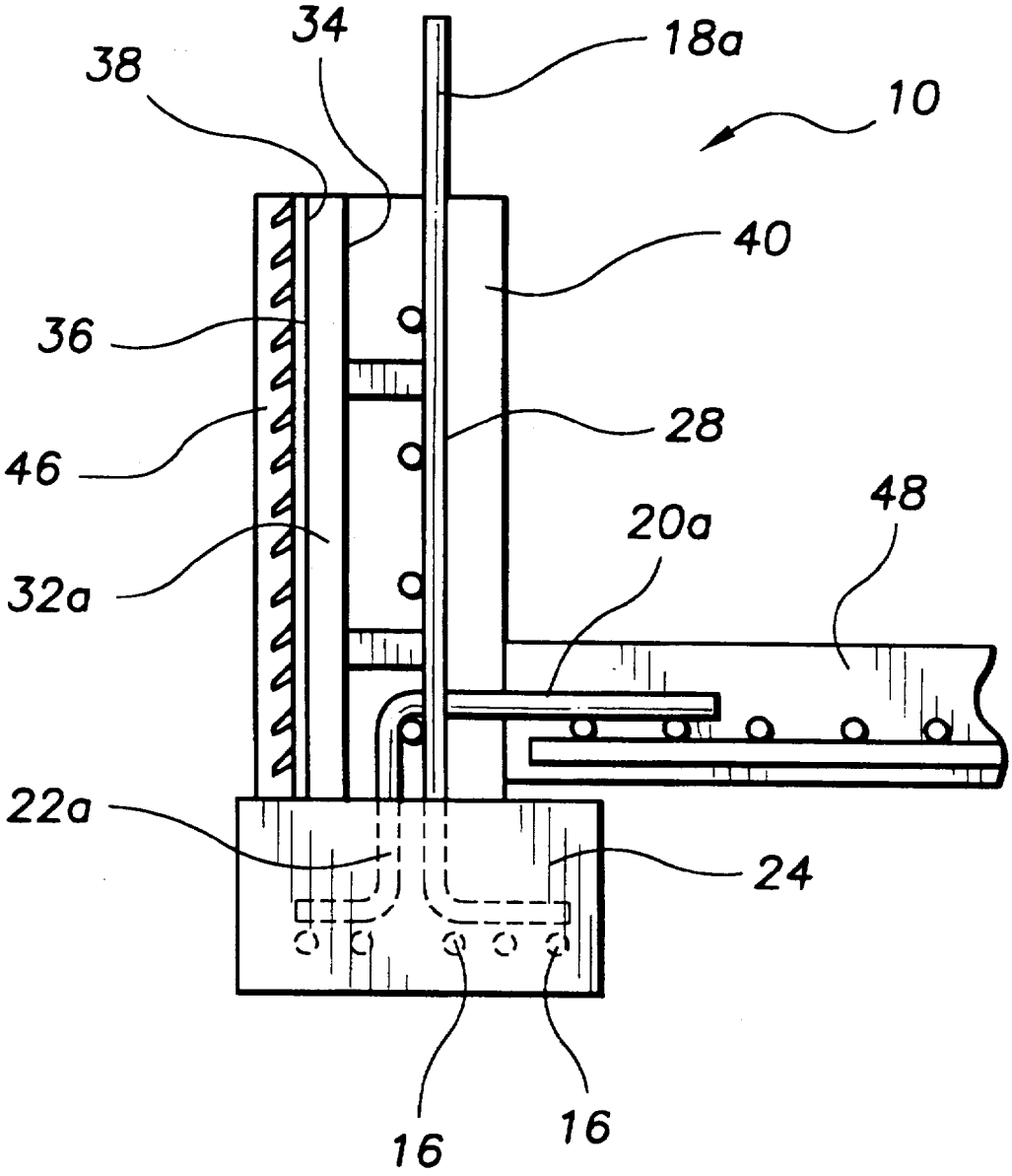
FIG. 2 is a plan view of the wall of FIG. 1 after the blown concrete has been blown, the stucco layer applied to the stucco lathe, and a concrete floor poured in connection with the floor reinforcing bars.

With reference to FIG. 2, following the above described securement, a blown concrete product 40 was then blown against first surfaces 34 and over reinforcing screen 28 until a desired wall thickness was achieved. The blown concrete was shaped and finished in the conventional manner to provide a vertical interior wall for the building. Wall 10 was completed by placing a coat of stucco 46 over stucco lathe 36 to provide an exterior surface for wall 10.

As discussed herein before, it can be seen that wall 10 has been constructed without the use of removable forms, that readily available materials have been used and that as a result of the elimination of the need for constructing and dismantling removable forms and the ability to use readily available materials, wall 10 is less expensive to construct. As an added benefit, multiple wall 10 can be used as forms for a conventionally constructed concrete slab 48 that is constructed in connection with horizontal reinforcing bars 20*a*, 20*b* to form the floor of building being erected.

It can be seen from the preceding description that a wall construction process has been provided that can be used to construct the load bearing walls of a concrete building; that is less expensive to implement than conventional concrete wall building processes; that uses a novel combination of readily available materials; and that does not require the use of removable forms for retaining the concrete during the curing period.

It is noted that the embodiment of the wall construction process described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirement of the law, it is to be understood that the details herein are to be interpreted as illustrative and not in a limiting sense.

What is claimed is:

1. A wall construction process for building a wall comprising the steps of:

a) providing a concrete footing having a plurality of vertical dowels each extending upwardly therefrom to a point past a top of the wall to be constructed;

b) constructing a reinforcing screen by attaching screen reinforcing bars to and across said plurality of vertical dowels;

c) providing a plurality of spacers;

d) placing said plurality of spacers adjacent to said reinforcing screen in a manner such that said spacers define a plane against which a substantially planar surface may be positioned;

e) providing a plurality of sheets of a foam insulating material having a first and second substantially planar surface;

f) positioning one of said first and second surfaces against said spacers;

g) providing a plurality of sheets of sheet-form lathe;

h) positioning said plurality of sheets of sheet-form lathe against said remaining first and second surfaces of said foam insulation that are not against said spacers;

i) fastening said plurality of sheets of sheet-form lathe, said plurality of sheets of foam insulation material, said spacers, and said reinforcing screen together in a manner such that each sheet of said plurality of sheets of foam insulation material is in contact with at least one spacer; and j) blowing a blown concrete mixture against said plurality of sheets of foam insulation material from a direction wherein said reinforcing screen is positioned between said plurality of sheets of foam insulation material and said nozzle from which said blown concrete is discharged.

* * * * *